United States Patent [19]

Dye

[11] 4,200,595

[45] Apr. 29, 1980

[54] CARBURETOR

[75] Inventor: S. Owen Dye, Highland, Ill.

[73] Assignee: ACF Industries, Inc., New York, N.Y.

[21] Appl. No.: 914,308

[22] Filed: Jun. 12, 1978

[51] Int. Cl.[2] ..... F02M 11/06

[52] U.S. Cl. ..... 261/39 B; 261/52

[58] Field of Search ..... 261/52, 39 B

[56] References Cited

U.S. PATENT DOCUMENTS

| | | | |
|---|---|---|---|
| 1,456,502 | 5/1923 | Hartwell | 261/52 |
| 2,082,710 | 6/1937 | Mallory | 261/52 |
| 2,198,676 | 4/1940 | Mallory | 261/52 |
| 2,557,111 | 6/1951 | Jorgensen et al. | 261/52 |
| 2,633,342 | 3/1953 | Baker | 261/52 |
| 2,694,558 | 11/1954 | Jorgensen et al. | 261/52 |
| 2,943,848 | 7/1960 | Gordon et al. | 261/52 |
| 3,249,344 | 5/1966 | Smith | 261/52 |
| 3,272,487 | 9/1966 | Cook et al. | 261/52 |
| 3,575,385 | 4/1971 | Szwargulski et al. | 261/52 |
| 3,862,278 | 1/1975 | Nakada | 261/52 |

*Primary Examiner*—Tim R. Miles

*Attorney, Agent, or Firm*—J. Joseph Muller; E. H. Casey

[57] ABSTRACT

A carburetor for an internal combustion engine. A carburetor body has an induction passage for air to be drawn into the engine. A throttle valve is positioned in the induction passage and is movable between an open and a closed position to control the quantity of air drawn into the engine. A staging valve is positioned in the induction passage and is movable between an open and a closed position. The staging valve is closed during engine cranking and is moved to a first open position when the engine starts and toward its fully open position as the engine warms up. The opening movement of the staging valve is limited to a second open position which is less than its fully open position. The limiting of staging valve movement to this second and less than fully open position limits the usable air capacity of the carburetor to less than its maximum capacity. Staging of the carburetor occurs in response to movement of the throttle valve past a predetermined open position and the staging valve is allowed to move freely between its second open position and a more fully open position solely in response to the demand for air by the engine. The free movement of the staging valve to its fully open position increases the usable air capacity of the carburetor to its maximum capacity.

12 Claims, 16 Drawing Figures

CARBURETOR

BACKGROUND OF THE INVENTION

This invention relates to carburetors and, more particularly, to a staged single barrel carburetor.

With the present trend in the automotive industry toward smaller, more fuel efficient automobiles, there is increasing demand for smaller displacement engines to serve as power plants for these vehicles. Thus, the eight cylinder engines that are standard on many of today's automobiles will increasingly give way to four and six cylinder engines. Concurrent with this changeover from large to smaller engines, there is a need to develop new carburetors for use with the new, smaller engines. The goal is to develop carburetors which promote improved fuel economy and reduced emissions and, at the same time, have good driveability and performance characteristics.

One approach to this problem has been the use of staging techniques, particularly the development of staged two-barrel carburetors. The advantage of a staged two-barrel or staged dual carburetor over a conventional two-barrel carburetor is that the staged two-barrel carburetor is, in effect, two carburetors, i.e., a single barrel carburetor for low speed, low load conditions in which fuel economy and reduced emissions are important and a two-barrel carburetor for high speed, high load conditions in which maximum or near maximum performance is required of the engine on which the carburetor is installed.

While staged dual carburetors help improve fuel economy and reduce emissions, they do have disadvantages. One of these is in the area of driveability. Specifically, there is a problem in that range of driving conditions where staging occurs, that is, when the secondary side of the carburetor comes into use. Prior to this time, fuel is flowing in the primary side of the carburetor, but not in the secondary side. When the transition occurs between one and two-barrel operation, there is a momentary lag in the secondary side operation because of the time needed for fuel to begin flowing in the secondary system. The result is a lag in engine performance which is noticeable to the driver.

Besides this problem, other factors bearing upon future carburetor design are carburetor size, since the carburetor must fit within a smaller engine compartment, weight, since the new smaller automobiles are also intended to be lighter in weight, and cost.

SUMMARY OF THE INVENTION

Among the several objects of the present invention may be noted the provision of such a single-barrel carburetor; the provision of such a carburetor having an air capacity comparable to multi-barrel, e.g., two-barrel carburetors; the provision of such a carburetor which is a staged carburetor and which achieves fuel economy and reduced engine emissions during the normal driving range of an automobile and which has the performance capability needed for high speed, high load driving conditions; the provision of such a carburetor in which the transition in carburetor operation that occurs at staging is accomplished without engine lag or a momentary lapse in engine performance; the provision of such a carburetor having an anterior valve in its throat which functions both as a choke valve during engine starting and engine warm up and as an air valve during other engine operating conditions; and the provisions of such a carburetor in which this anterior or staging valve is responsive only to engine air demand to vary the air capacity of the carburetor.

Briefly, a carburetor of the present invention is for an internal combustion engine and comprises a carburetor body in which an induction passage is formed for air to be drawn into the engine. A throttle valve is positioned in the induction passage and is movable between an open and a closed position to control the quantity of air drawn into the engine. A staging valve is positioned in the induction passage and is movable between an open and a closed position. The staging valve is closed during cranking of the engine and is moved to a first open position when the engine starts and toward its fully open position as the engine warm up. Means are provided for limiting the opening movement of the staging valve to a second open position which is less than its fully open position. The limiting of staging valve movement of this second and less than fully open position limits the usable air capacity of the carburetor to less than its maximum capacity. Staging means increases the air capacity of the carburetor. The staging means is responsive to movement of the throttle valve past a predetermined open position to allow the staging valve to move freely between its second open position and a more fully open position solely in response to the demand for air by the engine. The free movement of the staging valve to its fully open position increases the usable air capacity of the carburetor to its maximum capacity. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 7:
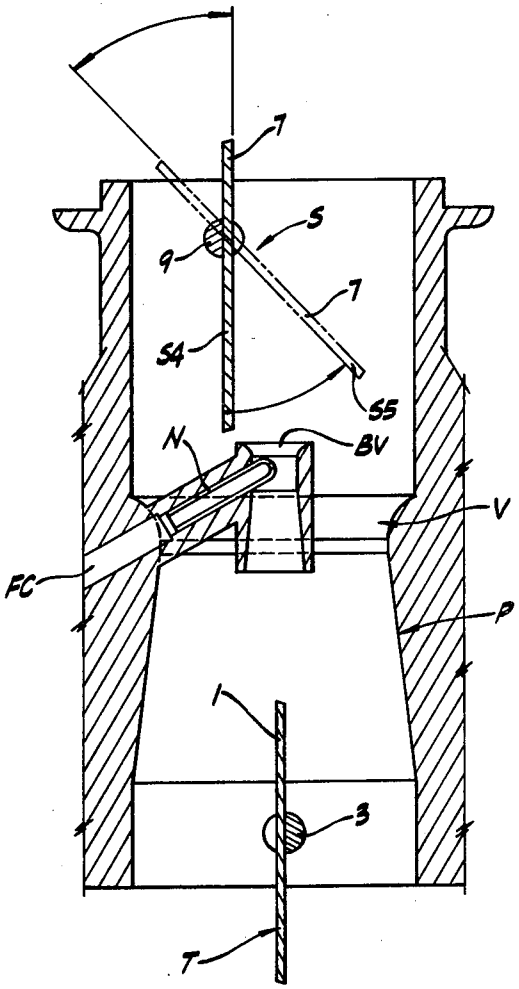
FIGS. 5–7 are simplified side elevational views, in section, of a carburetor of the present invention to aid in understanding operation of the carburetor.
Figure 6:
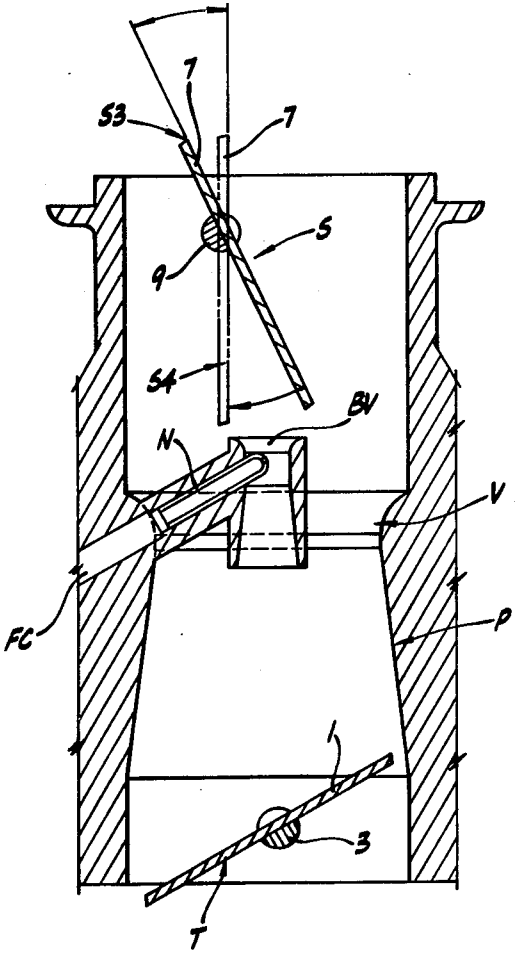
Figure 5:
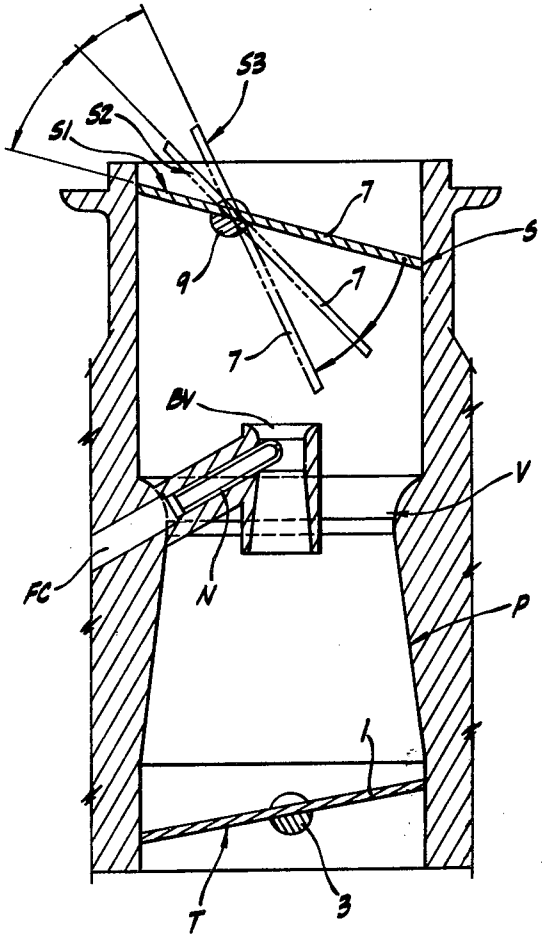

Referring to the drawings, a carburetor for an internal combustion engine (not shown) is indicated generally C and is comprised of three parts, an air horn H, a throttle flange F and a carburetor body B. The carburetor is mounted on an intake manifold (not shown) of the engine, and a single air induction passage P (see FIGS. 5–7) is formed in carburetor body B for air to be drawn into the engine. For this reason, carburetor C is commonly referred to as a single-barrel carburetor. The passage has a restricted section or venturi V to create a pressure drop in the passage and a boost venturi BV positioned in the passage at the venturi serves to increase the pressure drop. Fuel from a carburetor fuel bowl (not shown) is delivered to the passage through a fuel circuit FC (a portion of which is shown in FIGS. 5–7) and discharged into the passage through a nozzle N. The quantity of fuel discharged into the passage is a function of the pressure drop or nozzle signal created in the passage.

A throttle valve T is positioned in the induction passage, as its lower outlet end, and is movable between an open and a closed position to control the quantity of air drawn into the engine. Specifically, throttle valve T comprises a disk 1 mounted on a shaft 3 journalled for rotation. A throttle lever 5 is secured to the outer end of shaft 3 and is rotatable with the shaft. The throttle lever is connected to, for example, an accelerator pedal (not shown) operated by the driver of a vehicle in which the engine is installed so when the operator depresses the pedal, the throttle lever is rotated in a counterclockwise direction (as viewed in FIG. 2) to rotate shaft 3 and move the throttle valve from its closed position (see FIG. 5) through a series of intermediate open positions (for example, the position shown in FIG. 6) to its fully open position (see FIG. 7).

A staging valve S is positioned in the induction passage, at its upper inlet end, and is movable between an open and a closed position. Referring to FIGS. 5–7, the staging valve is anterior to, i.e. upstream of, the location of the main and boost venturis and nozzle N. The staging valve comprises a disk 7 mounted on a shaft 9 journalled for rotation. As seen in FIGS. 2 and 5–7, staging valve S is unbalanced. The staging valve is substantially closed during cranking of the engine so a suitably rich air-fuel mixture is supplied to the engine to start it.

Figure 2:
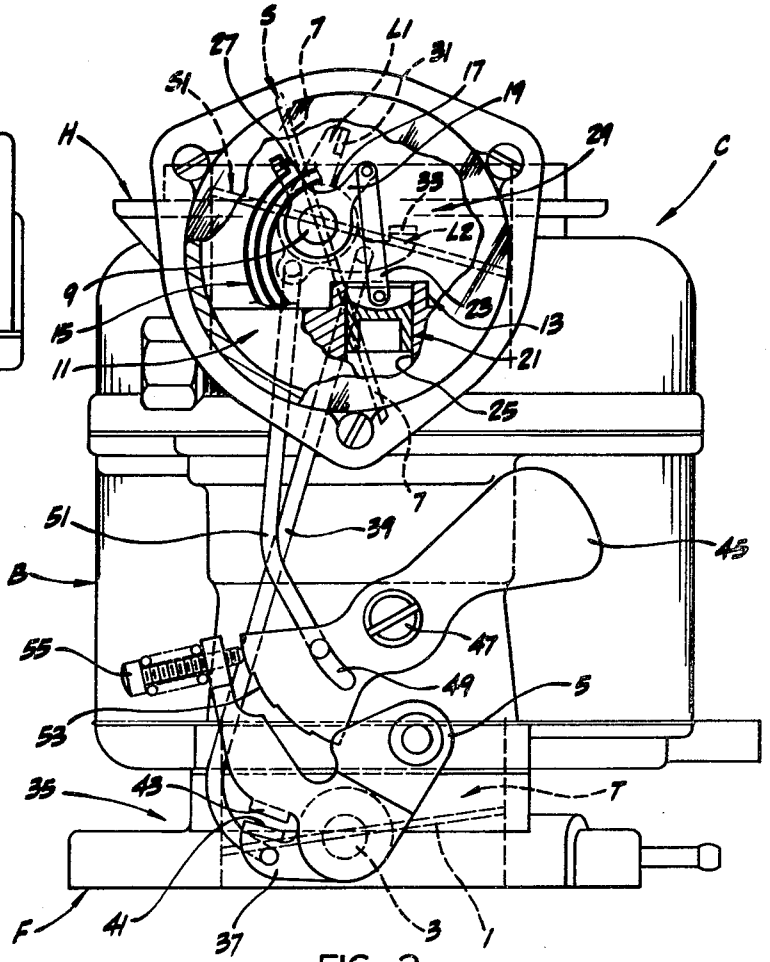
FIGS. 1 and 2 are front and side elevational views respectively of a first embodiment of a carburetor of the present invention, FIG. 2 being partly in section.
Figure 1:
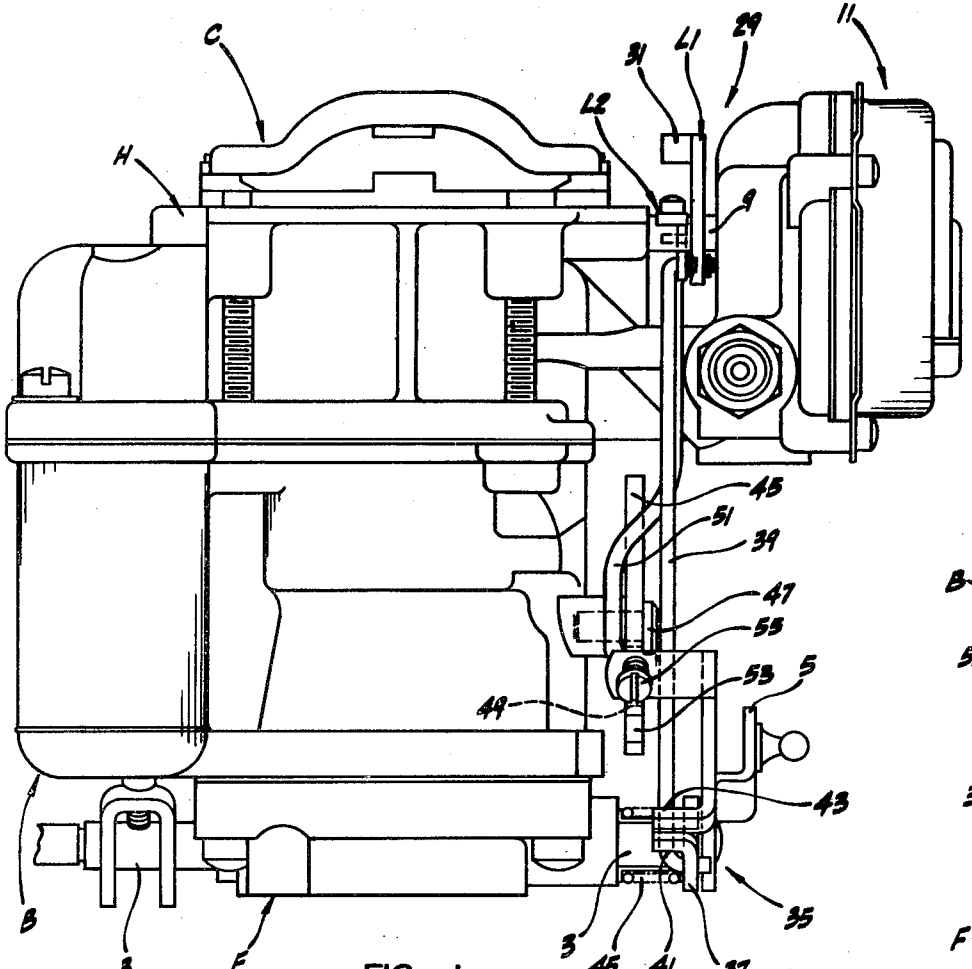

Means, generally designated 11, move the staging valve from its substantially closed position to a first open position when the engine starts and toward its fully open position as the engine warms up. Means 11 comprises a vacuum motor 13 and a thermostatic coil 15 (a portion of which is shown in FIG. 2). A lever 17 is secured to the outer end of staging valve shaft 9 and the lever has an arm 19 connected to a piston 21 of the vacuum motor by a link 23. The piston is reciprocal in a cylinder 25 of the vacuum motor, the cylinder being subjected to engine vacuum via a passage (not shown) extending between the lower end of the cylinder and the engine intake manifold. Choke lever 17 has a second and outwardly extending arm 27 and the outer end of coil 15 contacts arm 27 to urge the choke lever and the staging valve in a counterclockwise or staging valve closing direction.

The operation of moving means 11 is similar to that of a standard carburetor choke break. That is, when the engine is cold, coil 15 is contracted and pulls the staging valve to its substantially closed position (i.e., the position S1 shown in FIGS. 2 and 5). When the engine starts, the vacuum present in cylinder 25 pulls piston 21 downward with an opening force which is sufficient to partially overcome the closing force exerted on choke lever 17 by the thermostatic coil and the choke lever rotates clockwise to move the staging valve to its first open or choke break position (i.e., position S2 in FIG. 5). Thereafter, as the engine warms up, the heat generated by the engine causes thermostatic coil 15 to expand and the end of the coil contacting arm 27 of the choke lever rotates clockwise as viewed in FIG. 2. Because staging valve S is unbalanced, it tends to rotate clockwise and the restraining force placed on this movement by the thermostatic coil increasingly lessens as the engine gets hotter. This allows the staging valve to move from its first open position toward its fully open position.

Means, generally designated 29, limits the opening movement of the staging valve to a second open position (the position S3 in FIG. 5) which is intermediate its first open position and its fully open position. Means 29 includes a first lever L1 which is secured to staging valve shaft 9 for rotation with the shaft. The means further includes a second lever L2 which is a loose lever, i.e. it is rotatable about shaft 9. Levers L1 and L2 are so oriented with respect to each other that lever L1 contacts lever L2 as the staging valve opens and for this purpose, each lever has an inwardly projecting tab (tabs 31 and 33 respectively). As will be discussed, lever L2 is positioned so as to be spaced apart from lever L1, the spatial separation corresponding to the degree of opening of staging valve S as it moves from its closed position to its second open position. As shown in FIG. 2, the position of lever L2 is clockwise from that of lever L1. As the staging valve is moved from its closed to its first open position and then toward its fully open position, i.e. as the engine is started and warms up, lever L1 rotates in the clockwise direction and the separation between the levers decreases. When the staging valve reaches its second open position, tab 31 of lever L1 contacts tab 33 of lever L2. Lever L2 exerts sufficient force on lever L1 so as to restrain, i.e. limit, further opening movement of the staging valve and it is constrained to its second open position.

The limiting of staging valve S to this second and less than fully open position limits the usable air capacity of the carburetor. This is because staging valve S, when held at its second open position, acts as a partial obstruction to air being drawn into the engine through induction passage P.

A staging means, generally designated 35 increases the usable air capacity of the carburetor. Means 35 includes a staging lever 37 rotatable about throttle valve shaft 3 and a staging link 39 connecting the staging lever with lever L2. Link 39 forms a solid connection between the staging lever and lever L2. Staging lever 37 has an inwardly projecting tang or arm 41 and throttle lever 5 has an inwardly projecting tang or arm 43. A bias spring 45 urges staging lever 37 in a clockwise direction to position lever L2 with respect to lever L1 so lever L1 contacts lever L2 when the staging valve reaches its second open position.

When throttle valve T is closed, throttle lever 5 is spaced apart from staging lever 37 as shown in FIG. 2. As the throttle valve opens this spatial separation decreases until tang 43 of the throttle lever bears against tang 41 of the staging lever. When this occurs, the throttle valve has reached a predetermined open position. As the throttle valve moves past this predetermined open position, the throttle lever pushes the staging lever in a counterclockwise direction and lever L2 is pulled in a clockwise direction away from lever L1. When this happens, staging of carburetor C occurs and staging valve S, which previously had functioned as a choke valve, now functions as an air valve. That is, the staging valve is allowed to move freely between its second open position S3 and a more fully open position (position S4 in FIG. 6) solely in response to the demand for air by the engine. The more fully open position to which the staging valve moves is determined by the open position to which the throttle valve is moved. Thus, if the throttle valve is moved to its wide open position (see FIG. 7), the staging valve is freely movable to its wide open position and the free movement of the staging valve to its fully open position increases the usable air capacity of carburetor C to its maximum capacity. Further, since the throttle lever is so oriented with respect to the staging lever that it does not contact the staging lever until the throttle valve moves past its predetermined open position, any movement (opening or closing) of the throttle valve which does not move it past this position will not cause the lever L2 to be moved and the staging valve will continue to limit the usable air capacity of the carburetor. In addition, as the throttle valve more past its predetermined open position and toward its fully open position, the force of air on the staging valve will tend to keep lever L1 in contact with lever L2 even though lever L2 is continually being pulled in a clockwise direction by staging lever 37. This does not mean that the staging valve is being pulled open by lever L2, rather, the only opening force acting on the air valve is the force created by the demand for air by the engine. What it does means is that the throttle valve and staging valve will open in synchronism and this helps maintain the pressure drop created in the air induction passage and the nozzle signal on the carburetor's fuel circuit.

A fast idle cam 45 is rotatable about a spindle 47 and has a slot 49 in which one end of a link 51 is received. The other end of the link is attached to fixed lever L1. When the engine is cold, the one end of link 51 is at the bottom of slot 49, but as the engine starts and warms up, the opening movement of the staging valve causes the link to move up the slot. The fact idle cam has a contour surface 53 which is stepped and an adjustable screw 55 mounted on throttle lever 5 contacts this contour surface. As the throttle opens, the screw moves away from the contour surface of the cam and the cam rotates, by gravity until the bottom of slot 49 contacts the lower end of link 51. When the throttle valve closes, screw 55 contacts either the same step on the contour surface of the cam, or if the cam has rotated, a different step. As is well known in the art, the function of fast idle cam 45 serves to block the throttle valve partly open while the engine is warming up to keep it from stalling out when the throttle valve is closed, i.e. when the engine idles.

When throttle valve T is closed, staging lever 37 rotates clockwise and lever L2 moves lever L1 and staging valve S in a counterclockwise closing direction back to position S3. If the engine is not fully warmed up, the staging valve may continue moving toward position S2 under the influence of coil 15. However, due to vacuum motor 13, the staging valve cannot move past position S2 in its closing direction and the closing position of the staging valve will thus be between the first and second open positions of the valve.

Figure 3:
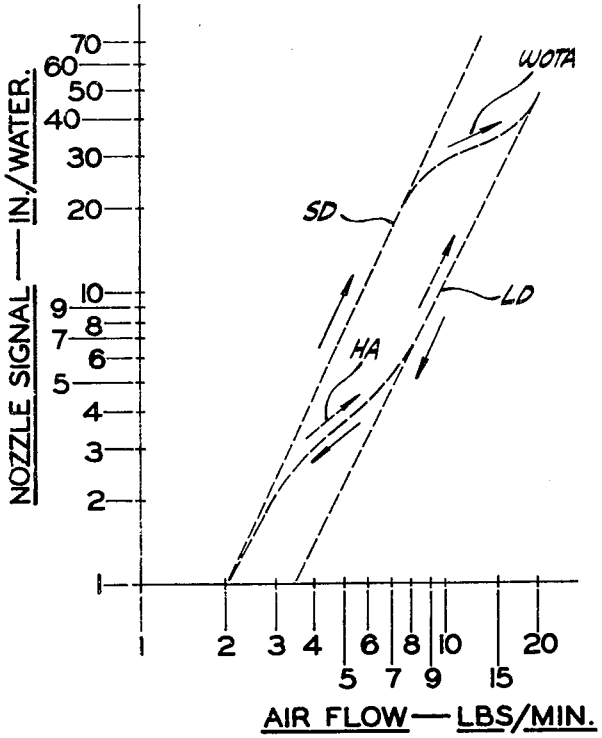
FIG. 3 is a graph illustrating the functioning of a carburetor of the present invention.

Referring to FIG. 3, the operation of carburetor C can be likened to that of a staged two-barrel carburetor. Two essentially parallel curves are shown in FIG. 3, each representing the plot of nozzle signal in inches (in.) of water versus air flow in pounds per minute (lbs/min). The curve SD on the left is equivalent to the curve for a carburetor having a smaller diameter air induction passage than that represented by the curve LD on the right. During normal or low load engine operating conditions, throttle valve T does not open past its predetermined open position and the staging valve is limited to its second open position. In these situations, the response of the carburetor follows curve SD with limiting means 29 limiting the opening movement of the staging valve to a second open position in which the resultant air-fuel mixture produced in the carburetor and combusted in the engine has an air-fuel ratio at which engine fuel economy is maximized and engine emissions are minimized.

When heavy engine loads are experienced, as, for example, when the engine is accelerated to wide open throttle, throttle valve T moves to its wide open position and the carburetor is staged with the staging valve being freed to move to its fully open position. In FIG. 3, this corresponds to the transition from curve SD to curve LD represented by arrow WOTA. This means that while carburetor C is capable of promoting good fuel economy and reduced engine emissions, it is also capable of providing the performance needed for heavy engine load conditions. The carburetor response follows curve LD as the engine load is reduced until, as shown in FIG. 3, there is a transition from curve LD back to curve SD. Finally, if the engine is subjected to a heavy acceleration from a rest or low load condition, the transition from curve SD to curve LD occurs almost at once, as indicated to arrow HA, with the carburetor following curve LD up to wide open throttle.

While the overall response curves shown in FIG. 3 are similar to those for a staged two-barrel carburetor, carburetor C does not have a performance lag such as is found in staged two-barrel carburetors when staging or the transition from curve SD to curve LD occurs. This is because carburetor C, since it is a single barrel carburetor, has only one fuel circuit FC through which fuel is drawn to an air induction passage and fuel is continuously flowing through this fuel circuit. This is not the case in staged two-barrel carburetors in which fuel is not flowing in the fuel circuit of the secondary side of the carburetor when staging occurs. The performance of such a carburetor during the time it takes for fuel to begin flowing in the fuel circuit of the secondary side of the carburetor noticeably lags and this lag does not occur in the staged single barrel carburetor of the present invention.

In order to have performance characteristics of a two-barrel carburetor, the cross-sectional area of induction passage P is comparable to the total cross-sectional area of the induction passage of a two-barrel carburetor. This permits the maximum air capacity of carburetor C to be comparable to that of a two-barrel carburetor. Thus, for example, the bore diameter of induction passage P is 1.5 inches (3.81 cm) and its maximum air capacity is 19 pounds of air per minute. This is comparable to the air capacity of presently available two-barrel carburetors. The limiting of staging valve opening with a carburetor C of this size permits control of the nozzle signal created in passage P so the carburetor, at normal load conditions, has performance characteristics of a smaller diameter carburetor, i.e. it response follows curve SD in FIG. 3. This insures good driveability at these low load or normal driving conditions as well as the fuel economy and reduced engine emissions previously discussed.

Figure 4:
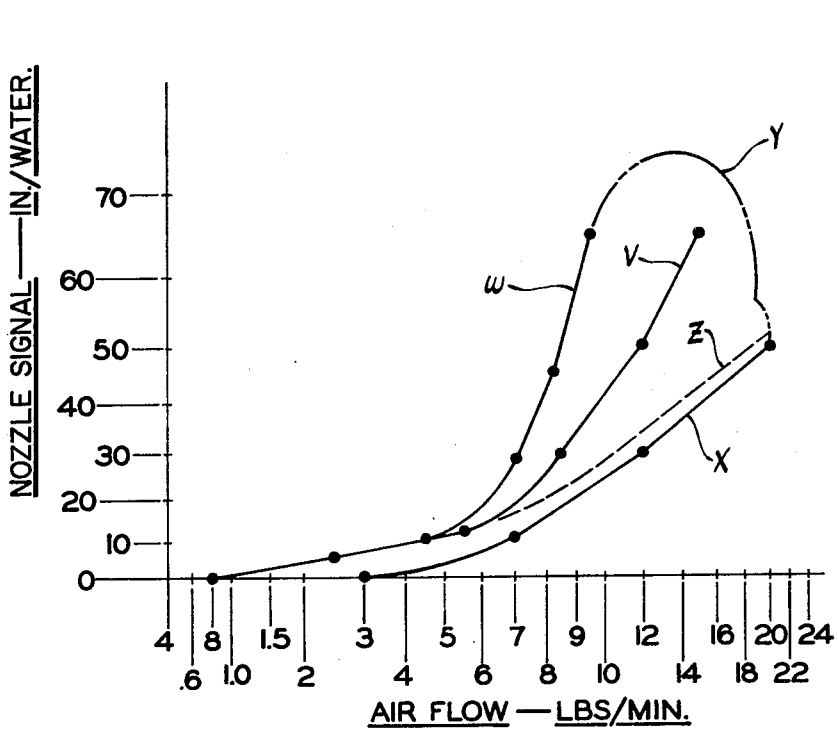
FIG. 4 is a graph illustrating the problem solved by a carburetor of the present invention.

Another approach to understanding the present invention is illustrated by the curves in FIG. 4 which are plots of nozzle signal versus air flow in pounds per minute. Curve V represents a carburetor having a maximum air capacity of 14 to 16 pounds of air (i.e. a carburetor such as that represented by curve SD in FIG. 3), and curve W represents the same carburetor having an obstruction which restricts air flow. Staging valve S, if restrained to its second open position throughout the opening movement of throttle valve T produces the effect shown in curve W. Curve X represents a carburetor of larger capacity than that represented by curve V (i.e. a carburetor such as that represented by curve LD in FIG. 3), the carburetor represented by curve X having a maximum air capacity of approximately 19 pounds. As noted, this is the maximum air capacity of carburetor C. In order for carburetor C to have the good fuel economy and reduced engine emissions of a smaller carburetor such as that represented by curve W and the performance needed at high engine load conditions and provided by a carburetor such as that represented by curve X, it must, in effect, transfer from a smaller capacity of a larger capacity carburetor. One transfer path is indicated by curve Y, but such a path has the disadvantage of having the maximum nozzle signal occur at a point other than the maximum air capacity of the carburetor. To obtain such a transfer path requires a fuel flow control which is difficult to attain. A preferable transfer path is indicated by curve Z and this path is achieved because staging means 35 frees the staging valve to move in response to engine air demand once the throttle valve of the carburetor opens past its predetermined open position. Thus, a smooth transition occurs which increases the usable air capacity of carburetor C to its maximum usable capacity and, at the same time, the nozzle signal created in air induction passage P does not require any complicated fuel control.

Figure 9:
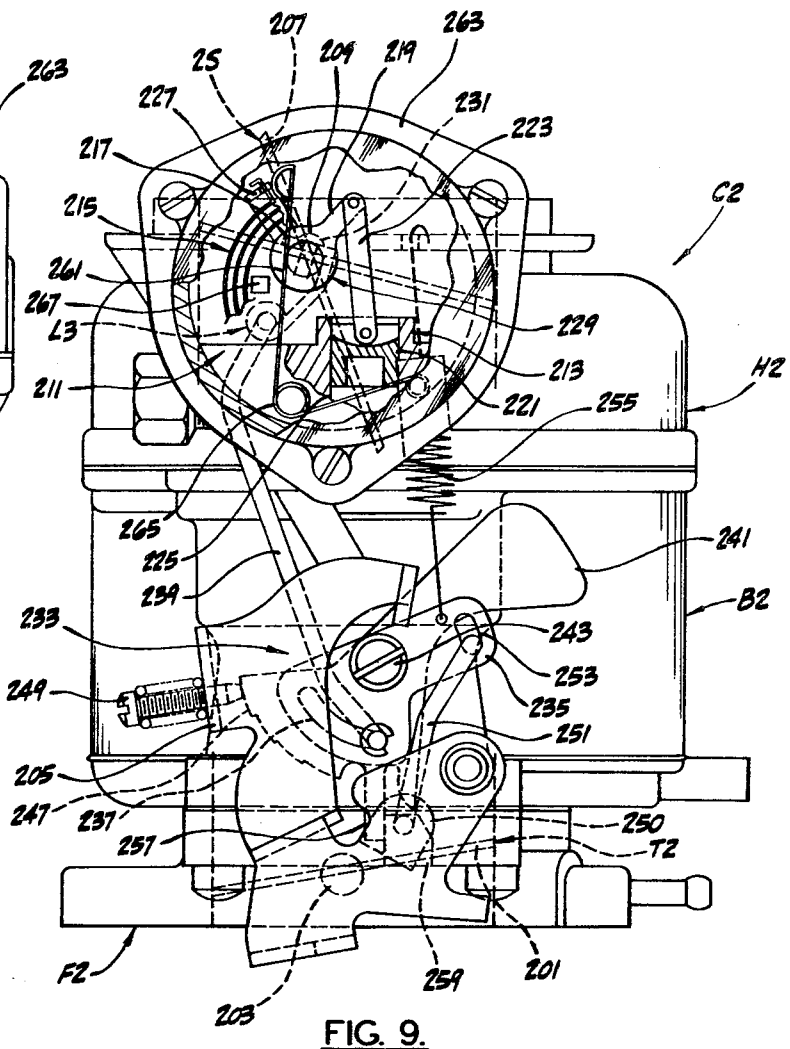
FIGS. 8 and 9 are front and side elevational views respectively of a second embodiment of a carburetor of the present invention, FIG. 9 being partly in section.
Figure 8:
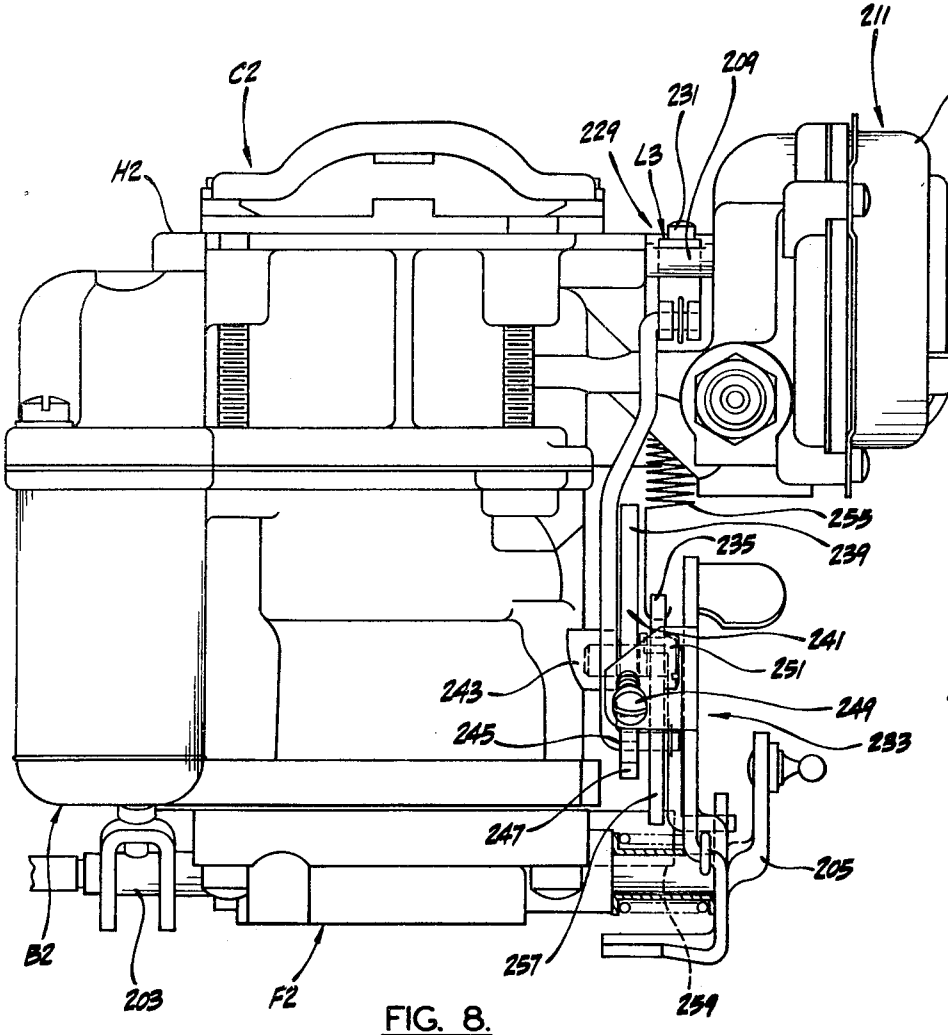
Figure 12:
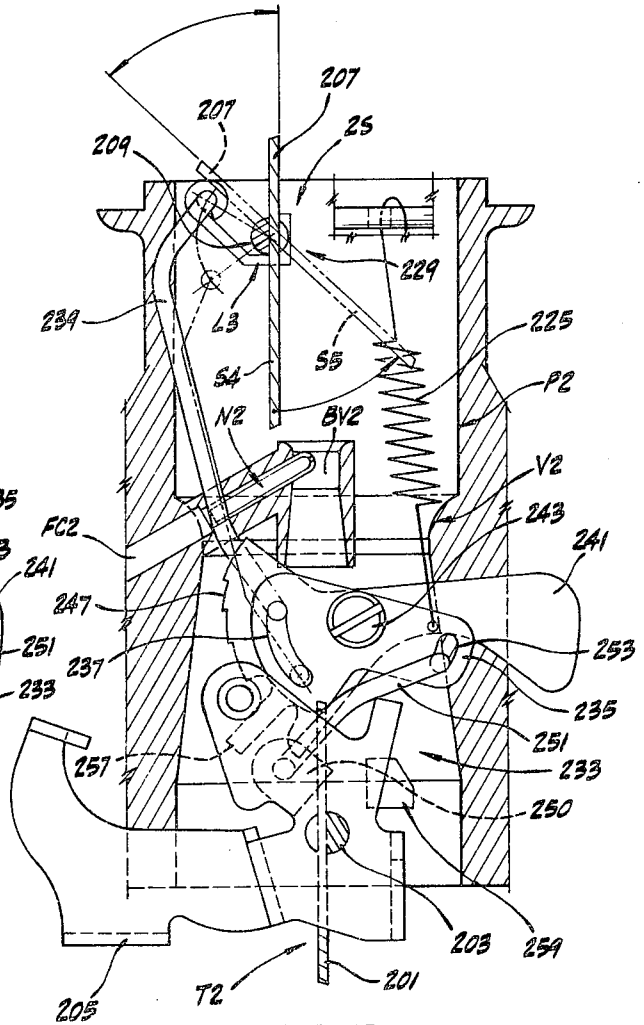
FIGS. 10–12 are side elevational views of the second embodiment of the carburetor illustrating the operation of the carburetor in a manner similar to that shown in FIGS. 5–7.
Figure 11:
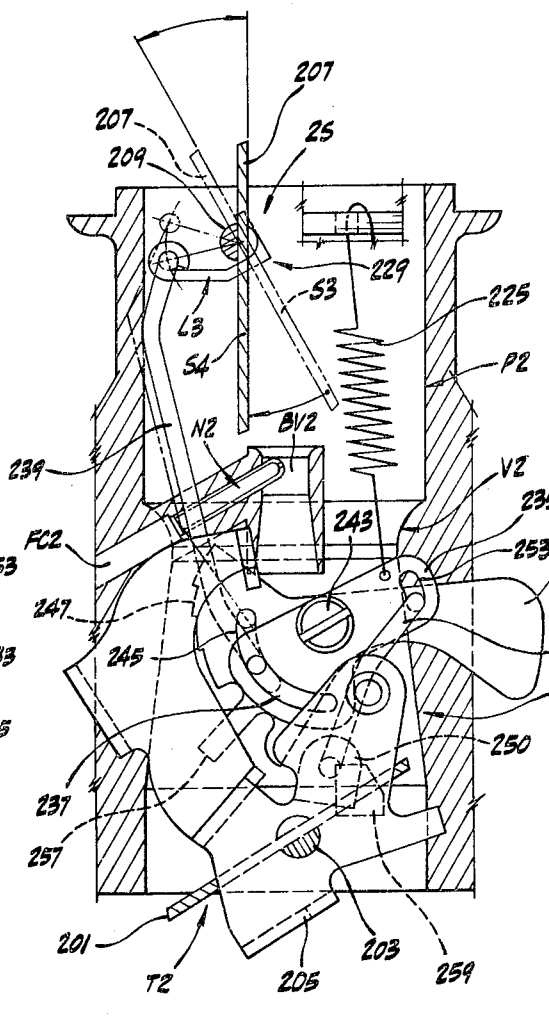
Figure 10:
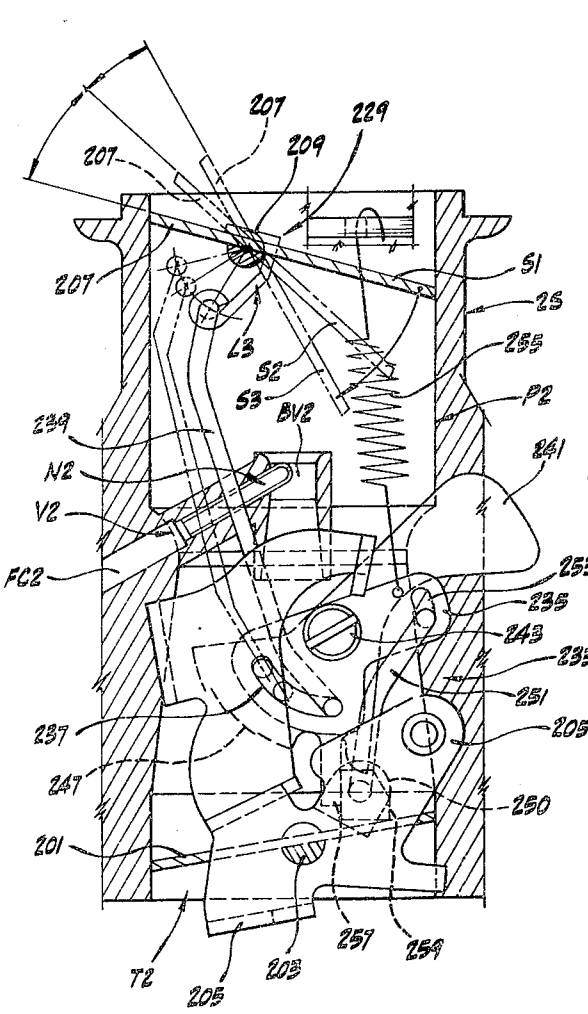

Referring to FIGS. 8 and 9, a second embodiment of carburetor C is indicated generally C2 with carburetor body B2 having an air induction passage P2 (see FIGS. 10–12). A throttle valve T2 positioned in the lower outlet end of the induction passage is comprised of a disk 201 mounted on a shaft 203 journalled for rotation and a throttle lever 205 is secured to one end of the throttle valve shaft for rotation with the shaft. A staging valve 2S is positioned at the upper inlet end of the induction passage and comprises a disk 207 mounted on a shaft 209 journalled for reaction. Means 211 moves the staging valve from its substantially closed position (position S1 in FIG. 10) to a first open position (position S2 in FIG. 10) when the engine on which the carburetor is installed starts and then moves toward its fully open position (position S4 in FIGS. 11 and 12) as the engine warms up. The moving means includes a vacuum motor 213 and a thermostatic coil 215 (a portion of which is shown in FIG. 9). A choke lever 217 is secured to the end of staging valve shaft 209 and the choke lever has an arm 219 connected to a piston 221 of the vacuum motor by a link 223. The piston is reciprocal in a cylinder 225 which is subjected to engine vacuum when the engine starts. The choke lever has a second and outwardly extending arm 227 which is contacted by the free end of thermostatic coil 215 as shown in FIG. 9. Operation of moving means 211 is the same as that of moving means 11 as previously described.

A means generally designated 229 limits the opening movement of the staging valve to a second open position (position S3 in FIGS. 10 and 11) which is intermediate the first open position of the staging valve and its fully open position. As previously indicated, the limiting of the staging valve to this second and less than fully open position limits the usable air capacity of the carburetor. Means 229 includes a lever L3 secured to staging valve shaft 209 for rotation with the shaft. Lever L3 is an L-shaped lever, the base of which is attached to the staging valve shaft by a screw 231. The leg of lever L3 is slightly bent and the end of the leg is turned over on itself to form a receptacle.

A staging means 233 serves to increase the usable air capacity of carburetor C2 and comprises a staging lever 235. The staging lever has an elongate curved slot 237, sometimes referred to as a "banana" slot and a link 239 connects the staging lever with lever L3. One end of link 239 is received in slot 237 and the other end of the link is captured in the receptacle formed at the end of the vertical leg of lever L3. As shown in FIG. 10, the lower end of link 239 is positioned at the lower end of slot 237 when the staging valve is substantially closed and travels along the length of the slot as the staging valve opens and lever L3 rotates clockwise with the staging valve shaft. When the staging valve moves to its first open position, the lower end of link 239 is moved to a position intermediate the ends of the slot and as the staging valve thereafter moves toward its open position, the lower end of the link moves to the upper end of the slot. When the lower end of link 239 reaches the upper end of slot 237, further opening movement of the staging valve is arrested and the open position attained by the staging valve when this occurs is the second open position of the staging valve.

A fast idle cam 241 is commonly mounted on a spindle 243 with staging lever 235 and the staging lever and the fast idle cam are independently rotatable about the spindle which serves as pivot for the staging lever. Fast idle cam 241 has a slot 245 which is substantially identical in size and in registry with slot 237 and, as shown in FIG. 8, the lower outwardly projecting end of link 239 extends through slot 245 and is received in slot 237. The fast idle cam has a stepped contour surface 247 which is contacted by an adjustable screw 249 mounted on throttle lever 205. The functioning of fast idle cam 241 to hold throttle valve T2 open during engine idle is the same as previously described. Since lever L3 moves link 239 in slot 245 of the fast idle cam as the staging valve opens, the fast idle cam rotates about spindle 243 as the throttle valve opens, the degree of rotation depending upon the extent of travel of link 239 along slot 245. It will be noted that rotation of the fast idle cam does not produce a corresponding rotation of staging lever 235.

Staging means 233 is responsive to the opening of throttle valve T2 past a predetermined open position to enable the staging valve to move freely between its second open position and fully open position solely in response to demand for air by the engine. Again, this free movement of the staging valve to its fully open position increases the usable air capacity of the carburetor to its maximum capacity. Throttle lever 205 has a rearward extension or ear 250 and the staging means further comprises a staging link 251 connecting the throttle lever with the staging lever. The staging lever has a second slot 253 which is on the opposite end of the lever from slot 237. As shown in FIGS. 9–12, this second slot is somewhat shorter than slot 237, but the length of this second slot is a function of the predetermined open position past which the throttle valve moves before the throttle lever produces rotation of the staging lever and staging of the carburetor occurs. One end of staging link 251 is captured in ear 250 and the other end of the link is received in slot 253. The link is slightly bent as indicated in the drawings in order for its respective ends to be fitted in their respective receptacles. A spring 255 has one end received in staging lever 235 and its other end received in an outwardly extending projection of the carburetor air horn. The spring urges the staging lever in a counterclockwise direction, as viewed in FIGS. 9–12, so a tang or finger 257 of the staging lever bears against a stop 259.

In operation, when throttle lever 205 is pulled in a counterclockwise direction to open throttle valve T2, staging link 251 is pushed upwardly in slot 253 toward the upper end of the slot. However, before the link reaches the upper end of the slot, the continued counterclockwise movement of the throttle lever (the continued opening of the throttle valve) pulls the staging link downward until it again reaches the lower end of the slot. When the throttle valve has opened to the point where this one end of the staging link is again at the lower end of slot 253, the throttle valve has reached its predetermined open position. Until this point is reached, staging lever 235 does not move and the staging valve is still limited to its second open position. With further opening movement of the throttle valve, the continued counterclockwise rotation of throttle lever 205 pulls the staging link against the lower end of slot 253 and produces clockwise rotation of the staging lever about its pivot. Slot 237 of the staging lever now moves relative to the end of link 239 received in the slot so the link is no longer at the upper end of the slot. Consequently, the staging valve is free to move from its second open position (position S3 in FIG. 11) toward its fully open position (position S4 in FIG. 11) in response to the demand for air by the engine.

It sometimes happens that at wide open throttle or near wide open throttle conditions, the engine demand for air decreases and when this occurs, the staging valve should be partly closed, that is, moved from its fully open position S4 to a partially open position S5 (see FIGS. 7 and 12). To accomplish this, a spring 261 is installed in a housing 263 in which the thermostatic coil 215 and vacuum motor 213 of moving means 211 are housed. Spring 261 is formed of a piece of bendable spring material which is partially coiled so the spring has a coiled center section and two oppositely extending arms, one of which is longer than the other. The coiled section of the spring fits over a hub 265 extending outwardly from the rear wall of the housing. The hub is located near the bottom of the housing and the shorter arm of the spring bears against the side of the housing. The longer arm of the spring extends upwardly and approximately midway along its length bears against the inside of a pedestal 267 which extends outwardly from the rear wall of the housing. The function of the pedestal is to preload the spring and constrain it from rotating in a counterclockwise direction as viewed in FIG. 9. Outwardly extending arm 227 of choke lever 217 (the arm of the choke lever contacting the outer end of thermostatic coil 215) contacts the outer end of the longer arm of spring 261, as the staging valve moves to its fully open position, and pushes it in a clockwise direction away from the side of pedestal 267. The closing force exerted on the staging valve by spring 261 is less than the opening force exerted on the staging valve as engine air demand increases, but when the staging valve is near or at its fully open position and the demand for air by the engine decreases, the force exerted on the choke lever by the spring is sufficient to overcome the opening force exerted on the staging valve by the engine's manifold vacuum and the air being drawn into the engine and the staging valve shaft is rotated clockwise until the staging valve reaches the position S5 shown in FIG. 12. At this position, the longer arm of spring 261 again bears against the side of pedestal 267.

It will be understood that spring 261 may also be installed in the housing of carburetor C in which thermostatic coil 15 and vacuum motor 13 are housed and that the spring, hub and pedestal are not shown in FIG. 2 only for the sake of drawing clarity.

Figure 14:
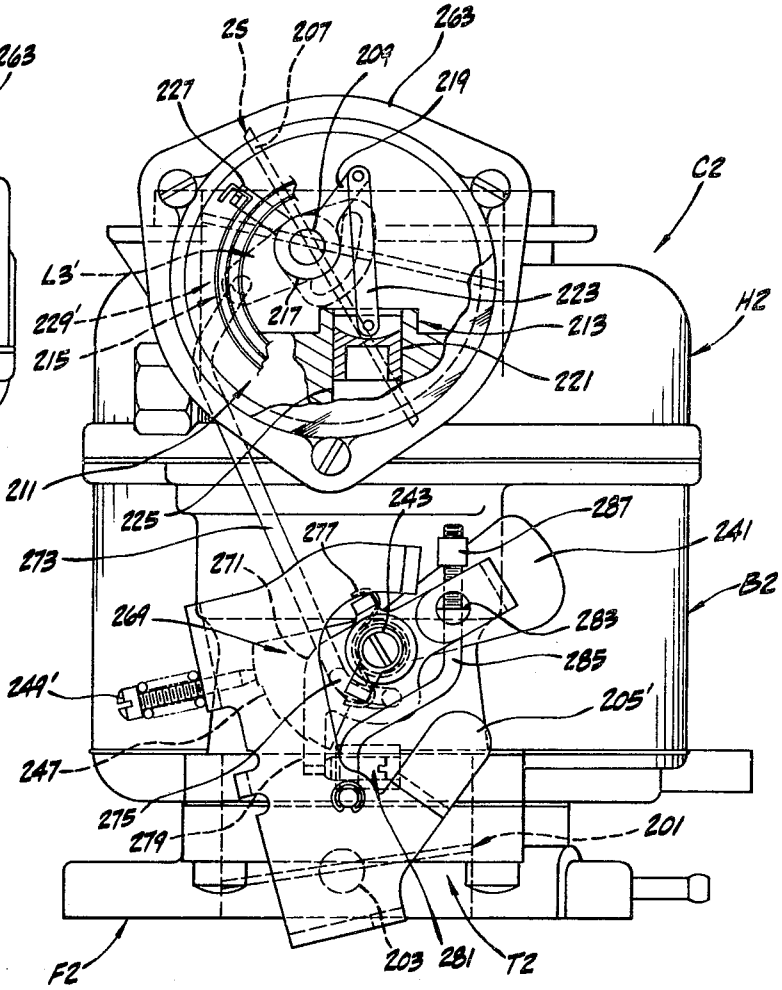
FIGS. 13 and 14 are front and side elevational views respectively of a third embodiment of a carburetor of the present invention, FIG. 14 being partly in section.
Figure 13:
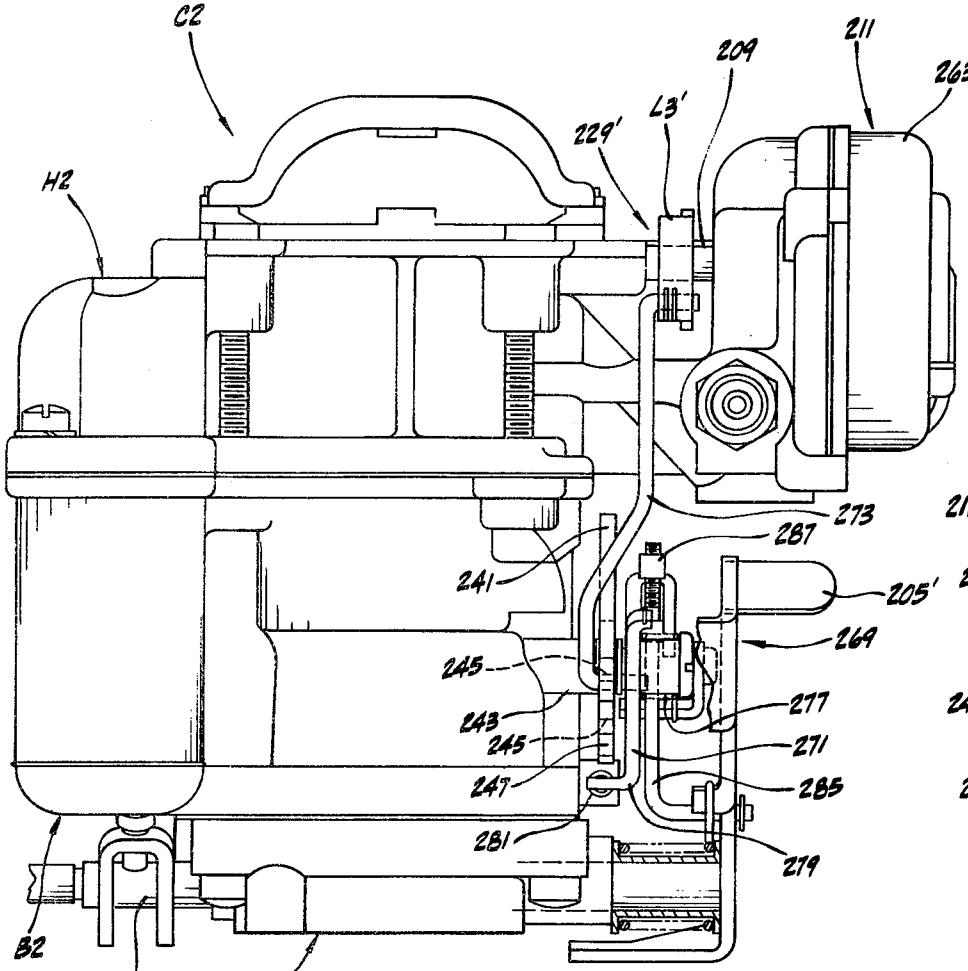

Referring to FIGS. 13 and 14, a third embodiment of a carburetor C of the present invention is similar to that of the embodiment shown in FIGS. 8–12 except for differences in the staging means. In this embodiment, limiting means 229' comprises a lever L3' which is secured to staging valve shaft 209 for rotation with the shaft.

A staging means 269 comprises a staging lever 271 commonly mounted on spindle 243 with fast idle cam 241. A link 273 connects the staging lever with lever L3'. The staging lever has an elongate curved slot 275 in which the lower end of link 273 is received and, as shown in FIG. 13, the lower end of the link extends through slot 245 in fast idle cam 241 as well as being received in slot 275. The movement of link 273 in slot 275 as the staging valve moves from its closed to its first open position and then toward its fully open position is the same as previously described with respect to the operation of staging means 233. A coil spring 277 fits over spindle 243 and urges the staging lever in a counterclockwise direction so a finger 279 of the staging lever beams against an adjustable stop 281. By adjusting the position of stop 281, the second open position to which opening movement of the staging valve is limited is adjusted. The end of the staging lever opposite finger 279 is U-shaped, as seen in FIG. 13, and a plate 283 is fitted within the U. A staging link 285 has one end secured to throttle lever 205' and the other end of the staging link extends upwardly through an opening in the plate. This latter end of the staging link is threaded for a collar 287 to be attached to the link. The collar is larger than the opening in plate 283 and the spatial separation between the bottom surface of the collar and the upper surface of the plate corresponds to the predetermined open position to which the throttle valve moves before the staging valve is freed to move between its second open position and its fully open position in response to engine air demand.

In operation, when the staging valve opens, the lower end of link 273 travels along slot 275 in staging lever 271 until it reaches the upper end of the slot at which time the opening movement of the staging valve is arrested. Thereafter, as the throttle valve opens, throttle lever 205' moves in a counterclockwise direction and pulls staging link to the left and down as viewed in FIG. 14. When the throttle vale opens past its predetermined open position, collar 287 contacts plate 283 and staging lever 271 is pulled in a clockwise direction. The upper end of slot 275 then moves relative to the lower end of link 273 and the staging valve is allowed to move between its second open position and its fully open position.

Figure 16:
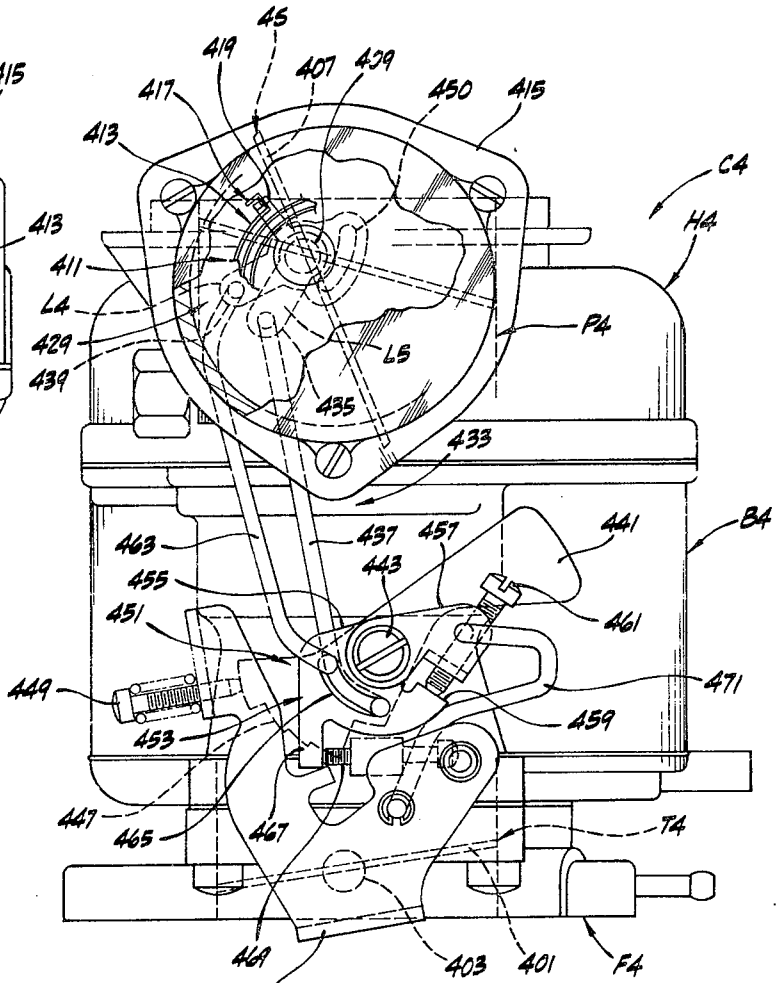
FIGS. 15 and 16 are front and side elevational views of a fourth embodiment of a carburetor of the present invention, FIG. 16 being partly in section.
Figure 15:
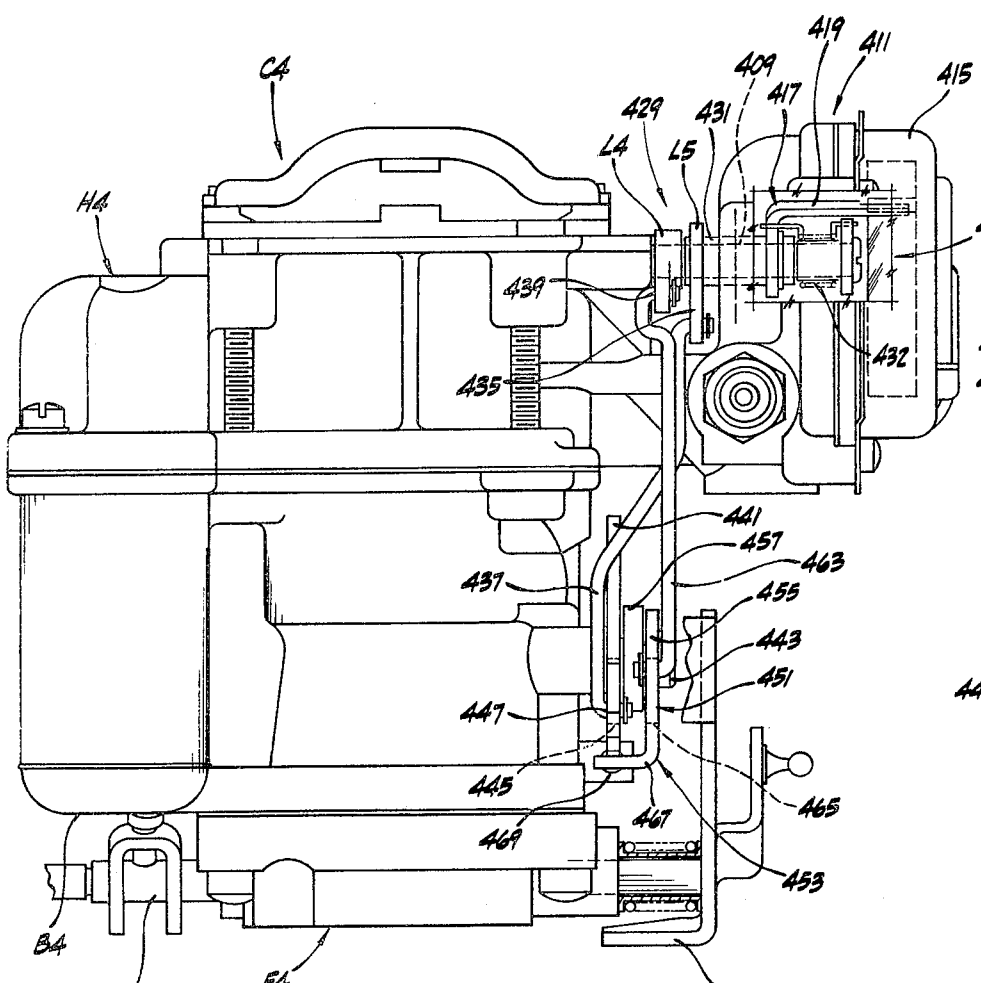

Referring to FIGS. 15 and 16, a fourth embodiment of a carburetor of the present invention is indicated C4 and comprises a body B4 in which an air induction passage P4 is formed. A throttle valve T4 is positioned at the lower outlet end of the induction passage and includes a disk 401 mounted on a shaft 403 journalled for rotation. A throttle lever 405 is secured to the outer end of shaft 403 for rotation with the shaft. A staging valve 4S is positioned at the upper inlet end of the induction passage and includes a disk 407 mounted on a shaft 409 journalled for rotation. As before, the staging valve is substantially closed during cranking of the engine so a suitably rich air-fuel mixture is supplied to the engine to start it.

A means 411 moves the staging valve to a first open position when the engine starts and toward its fully open position as the engine warms up. The moving means comprises a thermostatic coil 413 installed in a housing 415 and a vacuum motor (not shown) which is external to the housing. A choke lever 417 has an arm 419 contacting the free end of the thermostatic coil.

A fast idle cam 441 controls the degree of throttle valve closing during engine idle and the cam has a stepped contour surface 447 contacted by an adjustable screw 449 attached to throttle lever 405. The cam is rotatable about a spindle 443 to change the portion of the contour surface in contact with the throttle lever and thereby the degree of throttle valve closing, all as discussed hereinabove.

A limiting means 429 limits the opening movement of the staging valve to a second open position which is intermediate its first open position and its fully open position. The limiting means includes a lever L4 which is secured to shaft 409 and rotates with the shaft. As seen in FIG. 15, a second lever L5 is rotatable about shaft 409 and includes a collar 431 which fits over the end of shaft 429 and choke lever 417 rigidly fits on the outer end of this collar. A coil spring 432 (see FIG. 15) fits over shaft 409 and one end of the spring bears against choke lever arm 419 to urge the choke lever in a clockwise direction as seen in FIG. 16. Limiting means 429 includes a means 433 linking moving means 411 with fast idle cam 441 to control the movement of the fast idle cam and the portion of its contour surface in contact with the fast idle cam. Lever L5 has an arm 435 and the linking means includes a link 437 connecting the lever and the fast idle cam. The upper end of the link is attached to arm 435 of lever L5 and the lower end of the link is received in a fast idle cam slot 445. Slot 445 is an elongate curved slot in which the lower end of link 437 is movable and this lower end of the link is at the bottom end of the slot when the staging valve is closed. At that position, the link prevents rotation of the fast idle cam about its pivot when the throttle lever moves away from surface 447 of the cam. Lever L4 has an arm 439 to which is attached a link as described hereinafter. The vacuum motor is linked to lever L4 and, specifically, the vacuum motor, which may, for example, be a diaphragm motor of the type well known in the art, has a stem (not shown) received in a slot 450 on the opposite side of the lever from arm 439.

A staging means 451 comprises a staging lever 453 which is a split lever having two portions 455 and 457, respectively, which are movable relative to each other. Each portion of the lever is rotatable about spindle 443 and lever portion 455 has a contact surface 459 which is contacted by an adjustable screw 461 carried by portion 457 of the lever. The staging means further includes a link 463 connecting lever L4 with the staging lever. The upper end of the link is attached to arm 439 of lever L4 and the lower end of the link is received in an elongate curved slot 465 in staging lever portion 455. As before, slots 445 and 465 are substantially identical in size and are in registry. In FIGS. 15 and 16, link 463 is shown at the top of slot 465 and link 437 at the bottom of slot 445 for ease of understanding only. When the staging valve is closed, the lower end of the link is at the bottom of slot 465. As the staging valve moves to its first and then toward its fully open position, the link travels along the slot until it reaches the top of the slot at which time the opening movement of the staging valve is arrested. The staging lever is biased in a counterclockwise direction by a spring (not shown) so a finger 467 of the staging lever bears against an adjustable stop 469. By adjusting the position of the stop, the second open position to which the staging valve is allowed to move is adjusted. A staging link 471 forms a solid connection between throttle lever 405 and portion 457 of the staging lever.

In operation, when the engine on which the carburetor is mounted is cranked, the staging valve is closed and the position of shaft 409 is such that the lower end of links 437 and 463 are at the bottom of respective slots 445 and 465. When the engine starts, the vacuum motor to which lever L4 is connected pulls the lever in a clockwise direction to move the staging valve to its first open position. The movement of lever L4 moves the lower end of link 463 part way up slot 465 of staging lever 453, but lever L5 remains stationary and the lower end of link 437 remains at the bottom of slot 445. Thus, fast idle cam 441 is inhibited from rotating if throttle valve T4 is opened at this time. Initially, the closing force exerted on choke lever 417 by thermostatic coil 413 is greater than the force exerted on the lever by spring 432, but as the engine warms, this force gradually decreases and spring 432 urges the lever L5 assembly clockwise to move the staging valve toward its fully open position. As the staging valve continues to open, both levers L4 and L5 move with the valve and both links 463 and 437 move upward in their respective slots. When links 463 reaches the upper end of slot 465, further opening movement of the staging valve is arrested. However, if the throttle valve is opened, fast idle cam 441 may rotate, by gravity, about its pivot until the bottom end of its slot 445 strikes the lower end of link 437.

When throttle valve T4 opens counterclockwise, link 471 initially pushes portion 457 of staging lever 453 in a counterclockwise direction away from the other portion of the staging lever. As the throttle valve continues to open, portion 457 of the staging lever is pulled clockwise toward portion 455 of the lever until screw 461 contacts plate 459. While the one portion of the staging lever moves away from and back into contact with the other portion thereof, there is no movement of the staging valve. The position reached by the throttle valve when contact is again made between the staging valve portions is the predetermined open position which the throttle valve must pass before the staging valve is allowed to move between its second open position and its fully open position. As the throttle valve opens past this position, link 471 continues to pull staging lever portion 457 clockwise and screw 461 bears against plate 459. The staging lever now moves as a solid piece in a clockwise direction. Slot 465 of the staging lever moves relative to the lower end of link 463 and the staging valve is allowed to freely move between its second open position and its fully open position solely in response to demand for air by the engine. It will be noted that by adjusting screw 461, the predetermined distance past which the throttle valve must open before the staging valve is freed to move is adjustable.

It should be noted that the carburetor of the present invention is readily adaptable from an existing carburetor with a few changes, for example, removing a secondary boost venturi from the carburetor's air induction passage. However, it is also important to note that the capabilities and advantages of the carburetor of this invention reside in the use of a staging valve which, in effect, functions as a choke valve a portion of the time and as an air valve the rest of the time.

In the above description, the position S1 of the staging valve is, for example, approximately 15° below the horizontal position of the valve. The second open position (position S3) to which staging valve movement is limited is, for example, approximately 55° from the horizontal position of the staging valve, so the valve functions as a choke valve for approximately 40° of its opening movement. The staging valve is allowed to function as an air valve the 35° of its travel between its second open position and its fully open position (position S4). The position past which the throttle valve must move before the staging valve is allowed to function as an air valve is, as described, variable. However, the degree of opening may correspond, for example, to a 6 to 8 pound of air per minute demand by the engine.

In view of the above, its will be seen that the several objects of the invention are achieved and other advantages attained.

As various changes could be made in the above constructions without departing from the scope of the invention, it is intended that all matter contained in the above description or shown in the accompanying drawings shall be interpreted as illustrative and not in a limiting sense.

What is claimed is:

1. A carburetor for an internal combustion engine comprising:

a carburetor body in which an induction passage is formed for air to be drawn into said engine;

a throttle valve positioned in said induction passage and movable between a closed and an open position to control the quantity of air drawn into said engine;

an unbalanced staging valve positioned in said induction passage and movable between a closed and an open position, said staging valve being substantially closed during cranking of the engine whereby a suitable rich air-fuel mixture is supplied to the engine to start it;

vacuum means for moving said staging valve to a first open position when said engine starts;

thermostatic means for allowing said staging valve to move from its first open position toward its fully open position as said engine warms up;

means including first and second levers for limiting the opening movement of said staging valve to a second open position which is intermediate its first open position and its fully open position, the limiting of said staging valve to this second and less than fully open position limiting the usable air capacity of said carburetor; and staging means for increasing the usable air capacity of said carburetor, said staging means being responsive to the movement of said throttle valve past a predetermined open position for moving at least one of said levers to enable said staging valve to move freely between its second open position and a more fully open position solely in response to the demand for air by said engine, the more fully open position to which said staging valve is moved being determined by the position past the predetermined open position to which said throttle valve is moved, said staging valve being freely movable to its fully open position when said throttle valve is fully opened, the free movement of said staging valve to its fully open position increasing the usable air capacity of said carburetor to its maximum capacity, and said thermostatic means together with said vacuum means limiting the position to which said staging valve is moved when the throttle valve is closed to between the abovesaid first and second open positions during engine warmup.

2. A carburetor as set forth in claim 1 wherein said staging valve is mounted on a rotatable shaft and the first of said levers is secured to said staging valve shaft for rotation therewith and the second of said levers is rotatable about said staging valve shaft.

3. A carburetor as set forth in claim 2 wherein said first and second levers are so oriented with respect to each other that said first lever contacts said second lever as said staging valve opens and said second lever exerts sufficient force on said first lever to prevent further opening movement of said staging valve.

4. A carburetor as set forth in claim 3 wherein said throttle valve is mounted on a rotatable shaft and said staging means comprises a staging lever rotatable about said throttle valve shaft and a staging link connecting said staging lever with said second lever.

5. A carburetor as set forth in claim 4 wherein said staging means further includes means for positioning said second lever with respect to said first lever so said first lever contacts said second lever when said staging valve reaches its second open position.

6. A carburetor as set forth in claim 5 wherein a throttle lever is secured to said throttle valve shaft and is rotatable therewith, said throttle lever contacting said staging lever as said throttle valve opens to rotate said staging lever about said throttle valve shaft, movement of said staging lever producing movement of said second lever away from said first lever whereby said staging valve is responsive to engine air demand to freely move between its second open position and its fully open position.

7. A carburetor as set forth in claim 6 wherein said throttle lever is so oriented with respect to said staging lever that it does not contact said staging lever until said throttle valve moves past its predetermined open position and the movement of said second lever by said staging lever permits said staging valve to move between its second open position and its fully open position in synchronism with the continued opening movement of said throttle valve.

8. A carburetor as set forth in claim 7 further including means for partially closing said staging valve in response to a decrease in the demand for air by said engine.

9. A carburetor as set forth in claim 8 wherein a choke lever is secured to said staging valve shaft and is movable therewith, said choke lever being acted upon by said vacuum motor and said thermostatic coil to move said staging valve from its substantially closed position, said choke lever having an outwardly extending arm contacting said thermostatic coil.

10. A carburetor as set forth in claim 9, wherein said closing means comprises a spring contacted by said choke lever arm as said staging valve moves from its second open position to its fully open position, the force exerted on said arm by said spring being less than the opening force exerted on said staging valve as engine air demand increases, but sufficient to overcome the opening force exerted on said staging valve as engine air demand decreases whereby said springs acts on said choke lever to rotate said staging valve shaft in a staging valve closing direction.

11. A carburetor for an internal combustion engine comprising:

a carburetor body in which an induction passage is formed for air to be drawn into said engine;

a throttle valve positioned in said induction passage and movable between a closed and an open position to control the quantity of air drawn into said engine;

a staging valve positioned in said induction passage and mounted on a rotatable shaft for movement between a closed and an open position, said staging valve being substantially closed during cranking of the engine whereby a suitably rich air-fuel mixture is supplied to the engine to start it;

a choke lever secured to said staging valve shaft and movable therewith;

means for moving said staging valve to a first open position when said engine starts and toward its fully open position as said engine warms up, said moving means including a vacuum motor and a thermostatic coil acting on said choke lever to move said staging valve from its substantially closed position, said choke lever having an outwardly extending arm contacting said thermostatic coil;

means including first and second levers for limiting the opening movement of said staging valve to a second open position which is intermediate its first open position and its fully open position, the limiting of said staging valve to this second and less than fully open position limiting the usable air capacity of said carburetor;

staging means for increasing the usable air capacity of said carburetor, said staging means being responsive to the movement of said throttle valve past a predetermined open position for moving at least one of said levers to enable said staging valve to move freely between its second open position and a more fully open position solely in response to the demand for air by said engine, the free movement of said staging valve increasing the usable air capacity of said carburetor; and means for partially closing said staging valve in response to a decrease in the demand for air by said engine, said closing means comprising a spring contacted by said choke lever arm is said staging valve moves from its second open position to its fully open position, the force exerted on said arm by said spring being less than the opening force exerted on said staging valve as engine air demand increases, but sufficient to overcome the opening force exerted on said staging valve as engine air demand decreases whereby said spring acts on said choke lever to rotate said staging valve shaft in a staging valve closing direction.

12. A carburetor for an internal combustion engine comprising:

a carburetor body in which an induction passage is formed for air to be drawn into said engine;

a throttle valve positioned in said induction passage mounted on a rotatable shaft for movement between a closed and an open position to control the quantity of air drawn into said engine;

a throttle lever secured to said staging valve shaft and rotatable therewith;

a staging valve positioned in said induction passage and mounted on a rotatable shaft for movement between a closed and an open position, said staging valve being substantially closed during cranking of the engine whereby a suitably rich air-fuel mixture is supplied to the engine to start it;

means for moving said staging valve to a first open position when said engine starts and toward its fully open position as said engine warms up, said moving means comprising a vacuum motor acting on said staging valve shaft to move said staging valve from its substantially closed position to its first open position, a thermostatic coil acting on said staging valve shaft to move said staging valve from its first open position toward its fully open position, and a choke lever secured to said staging valve shaft and movable therewith, said choke lever being acted upon by said vacuum motor and said thermostatic coil to move said staging valve from its substantially closed position, said choke lever having an outwardly extending arm contacting said thermostatic coil;

means including first and second levers for limiting this opening movement of said staging valve to a second open position which is intermediate its first open position and its fully open position, the limiting of said staging valve to this second and less than fully open position limiting the usable air capacity of said carburetor, the first of said levers being secured to said staging valve shaft for rotation therewith and the second of said levers being rotatable about said staging valve shaft, said first and second levers being so oriented with respect to each other that said first lever contacts said second lever as said staging valve opens and said second lever exerts sufficient force on said first lever to prevent further opening movement of said staging valve;

staging means for increasing the usable air capacity of said carburetor, said staging means being responsive to the movement of said throttle valve past a predetermined open position for moving at least one of said levers to enable said staging valve to move freely between its second open position and a more fully open position solely in response to the demand for air by said engine, and said staging means comprising a staging lever rotatable about said throttle valve shaft and a staging link connecting said staging lever with said second lever, means for positioning said second lever with respect to said first lever so said first lever contacts said second lever when said staging valve reaches its second open position, said throttle lever contacting said staging lever as said throttle valve opens to rotate said staging lever about said throttle valve shaft, movement of said staging lever producing movement of said second lever away from said first lever whereby said staging valve is responsive to engine air demand to freely move between its second open position and a more fully open position, said throttle lever being so oriented with respect to said staging lever that it does not contact said staging lever until said throttle valve moves past its predetermined open position and the movement of said second lever by said staging lever permits said staging valve to move between its second open position and its fully open position in synchronism with the continued opening movement of said throttle valve; and means for partially closing said staging valve in response to a decrease in the demand for air by said engine, said closing means comprising a spring contacted by said choke lever arm as said staging valve moves from its second open position to its fully open position, the force exerted on said arm by said spring being less than the opening force exerted on said staging valve as engine air demand increases, but sufficient to overcome the opening force exerted on said staging valve as engine air demand decreases whereby said spring acts on said choke lever to rotate said staging valve shaft in a staging valve closing direction.

* * * * *